United States Patent [19]

Balogh

[11] 4,082,073

[45] Apr. 4, 1978

[54] ENGINE SPEED GOVERNOR WITH IMPROVED PEAK LOAD CONTROL

[75] Inventor: Richard L. Balogh, Livonia, Mich.

[73] Assignee: General Motors Corporation, Detroit, Mich.

[21] Appl. No.: 696,585

[22] Filed: Jun. 16, 1976

[51] Int. Cl.[2] ..... F02D 1/04

[52] U.S. Cl. ..... 123/140 R

[58] Field of Search ..... 123/140 R

[56] References Cited

U.S. PATENT DOCUMENTS

| | | | |
|---|---|---|---|
| 2,669,983 | 2/1954 | Reddy et al. | 123/140 R |
| 3,014,475 | 12/1961 | Frick et al. | 123/140 R |
| 3,058,455 | 10/1962 | Hofer et al. | 123/140 R |
| 3,289,661 | 12/1966 | May et al. | 123/140 R |
| 3,566,849 | 3/1971 | Frick | 123/140 R |
| 3,886,922 | 6/1975 | Frick | 123/140 R |
| 3,916,862 | 11/1975 | Clouse et al. | 123/140 R X |

*Primary Examiner*—Charles J. Myhre
*Assistant Examiner*—Tony M. Argenbright
*Attorney, Agent, or Firm*—Robert J. Outland

[57] ABSTRACT

A mechanical engine governor having centrifugal flyweights opposed by a high speed spring and a peak load control spring that acts against the high speed spring in a portion of its travel to flatten the peak horsepower curve wherein the combined springs have a decreasing rate to offset the exponential increase of force with speed of the flyweights and provide a fuel control actuating movement which is a constant function of the engine speed change. In a fuel-injected diesel engine having constant fuel input per cycle over the speed range, the result is a substantially constant maximum horsepower rating over a wide speed range. A power adjustment feature may also be provided.

8 Claims, 6 Drawing Figures

ENGINE SPEED GOVERNOR WITH IMPROVED PEAK LOAD CONTROL

BACKGROUND OF THE INVENTION

This invention relates to mechanical engine governors for internal combustion engines and, more particularly, to the provision of peak load control spring means for flattening the high speed portion of the engine horsepower curve in combination with a maximum-idle speed governor of a type commonly used on diesel engines for automotive vehicles.

It is known in the art relating to governors for compression ignition engines to provide a mechanical governor for controlling engine idle speed, as well as preventing operation above a preset maximum speed range. One type of governor used for such purposes includes centrifugal flyweights which act through a linkage against an idle speed spring and, upon its full compression, on a high speed spring to control fuel input and limit maximum engine speed. Between idle and maximum speeds the fuel input is controlled manually by the operator of the engine or vehicle over a normal load or horsepower output curve which increases with engine speed up to the maximum speed setting. At this point the governor reduces fuel input to prevent overspeeding the engine.

The rising horsepower curve characteristics of such engine-governor arrangements led to the development of truck transmissions, for example, having many gear ratio selections so that the operator might select for any given condition a ratio that would permit operation of the engine at or near its maximum horsepower range. In some cases the numerous gear changes used to operate a truck at maximum power over varying highway speeds involved excessive shifting which tended to actually reduce overall operating efficiency of the vehicle. To overcome this, various engine and control developments have been made to provide a more constant horsepower output over a wider speed range than was previously available.

One such development involved the modification of a conventional mechanical engine speed governor to provide peak load control by incorporating a peak load control spring in the governor speed control mechanism where it opposes the bias of the usual high speed spring only during an initial portion of its speed controlling movement. This has the effect of flattening the load curve near the maximum speed setting of the governor, thus providing for a more constant horsepower output of the engine over an extended speed range. An arrangement of this sort is disclosed in U.S. Pat. No. 3,886,922 Frick, granted June 3, 1975 to the assignee of the present invention.

SUMMARY OF THE INVENTION

The present invention provides a mechanical engine governor which is, in many respects, similar in construction and operation to the governor disclosed in the above-mentioned U.S. Pat. No. 3,886,922. However, it incorporates certain novel improvements and modifications that provide additional features and operating advantages over the prior arrangement.

For example, the present invention provides a modified peak load control spring construction which gives on compression a decreasing spring rate. This rate is matched to offset some of the increase of force of the centrifugal flyweight mechanism utilized for speed control so as to provide the characteristic that movement of the fuel control or actuating means during the load control portion of travel near the maximum fuel position equals a substantially constant function of the change in engine speed during that portion of travel of the actuating means. This characteristic, when applied to a diesel engine in which the fuel injectors deliver fuel to the cylinders at a relatively constant rate per cycle, permits the governor to vary the injector fuel rate upon changes in engine speed so as to maintain the absolute fuel rate to the engine approximately constant over the peak load control portion of the governor control range, thus maintaining engine horsepower at a relatively constant value during such portion.

Further, the invention provides a load control spring construction of the nonplanar washer type and preferably having a dished or Belleville spring construction, which is adapted to provide the desired declining rate upon compression, while being easily applied in the particular governor arrangement.

Also, the invention provides a mounting arrangement for the peak load control spring which includes means to adjust its preload at the point of initial action and to locate the adjusting means under a removable cover for easy access.

These and other features and advantages of the improved governor arrangement will be more fully understood from the following description of certain specific embodiments, taken together with the accompanying drawing.

DETAILED DESCRIPTION

Figure 1:
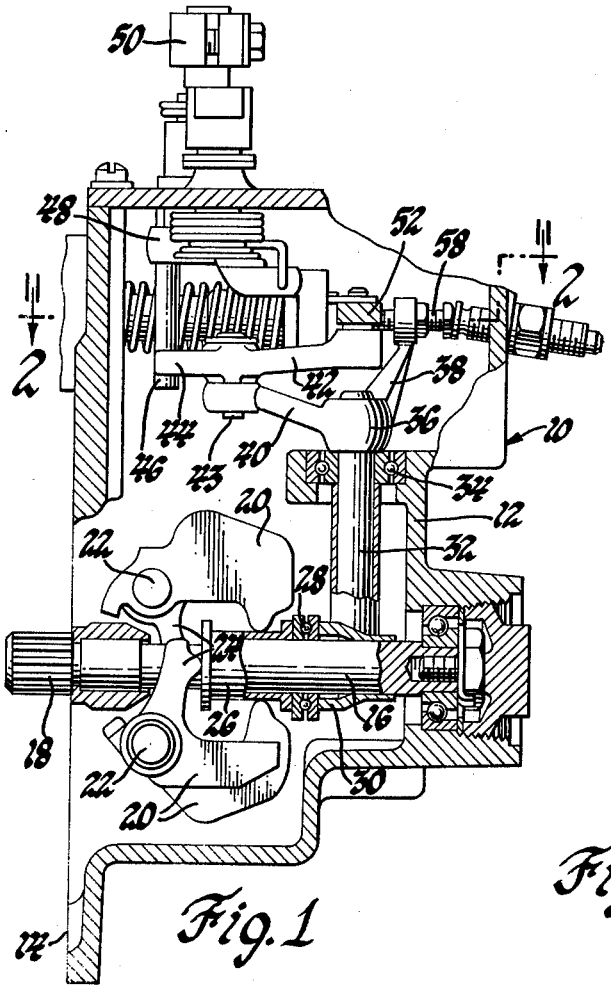
FIG. 1 is a cross-sectional view showing part of the mechanism of a mechanical engine governor formed according to the invention.

Referring now to the drawings in detail, numeral 10 generally indicates a mechanical engine governor for an internal combustion engine and particularly for an engine of the compression ignition type. The governor includes a housing 12 having a mounting surface 14 which is adapted to be secured to the end face of the blower housing or other suitable portion of a compression ignition engine, not shown.

Within the housing 12 is a rotatable shaft 16 having a splined end portion 18 that is adapted to be connected to the rotating blower shaft, or other suitable portion of the engine, for driving the shaft 16 at speeds proportional to engine speeds. Shaft 16 carries one or more pivotally mounted flyweights 20 which, upon increasing speed, are increasingly urged outwardly by centrifugal force around pivots 22. Fingers 24 extending from the flyweights engage a sleeve 26 which acts through a bearing 28 on an operating fork 30. The fork 30 is connected to an operating shaft 32 that is mounted for oscillation in a bearing, only one 34 of which is shown. Operating shaft 32 is fixed to an operating shaft lever 36 having a pair of angularly disposed arms 38, 40.

At the end of arm 40 of the operating lever, a differential lever 42 is pivotably mounted intermediate its end on a pivot pin 43. One end of lever 42 is bifurcated at 44 to receive the end of a pin 46, extending from operating mechanism 48, adapted to be connected through an external lever 50 with the accelerator pedal, not shown, of a vehicle, or other means for manual control of the engine by the operator. At its other end, differential lever 42 is pinned to a link 52 which is in turn connected to an oscillating lever 54 having an end portion 56 connectable with engine fuel rack actuating means, not shown, for moving the engine injector racks between maximum and minimum fuel positions.

The other arm, 38, of operating shaft lever 36 carries an adjusting screw 58 which engages a cup-shaped cap 60 carried for reciprocation within a recess 62 of a cylindrical plunger 64. A low (idle) speed spring 66 extends between the cap 60 and a seat 68 connected to the plunger 64 by subsequently described adjustable means for setting the spring preload. A flange stop 70 on the cap 60 is engageable with the end of the plunger 64 to limit compression of the spring 66 and provide a solid connection thereafter between the lever 36 and the plunger 64.

An adjustable cup-like retainer 72, surrounding part of the plunger 64, receives and supports one end of a high speed spring 74. The other end of the spring 74 acts against a flange 76 on the plunger 64, biasing the plunger to the right, as viewed in FIG. 2. Plunger 64 is reciprocably supported in the bore 78 of a support member 80 which forms a portion of the housing 12. An annular abutment 82 surrounds the bore 78 and is located in opposition to the flange 76 of the plunger, which is biased toward the abutment by the high speed spring 74.

The portions of the governor embodiment so far described are essentially the same as the corresponding portions of the governor disclosed in the previously mentioned U.S. Pat. No. 3,886,922. Thus, corresponding reference numerals have been used for ease of comparison. Although not illustrated in the prior patent, the constructions of the governor embodiments are additionally similar in that the cup-like retainer 72 is threadably received in the governor housing 12 and is longitudinally adjustable by rotation therein for the purpose of setting the preload on the high speed spring 74. A nut 84, carried on the retainer 72, is engageable with the housing 12 to lock the retainer in its adjusted position.

The retainer and the additional mechanism to be subsequently described are enclosed by a removable cover 86, which is secured to the governor housing 12 by screws or other suitable fastening means, not shown. If desired, the form of cover illustrated may be replaced by a tamper resistant cover arrangement of the type shown in U.S. Pat. No. 3,893,441 Hebb, Jr. and Baugh, granted July 8, 1975 to the assignee of the present invention.

Figure 3:
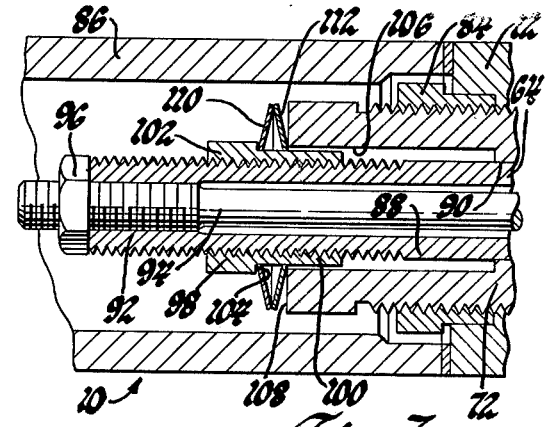
FIG. 3 is a fragmentary view of a portion of FIG. 2 enlarged to show certain details of the mechanism.
Figure 2:
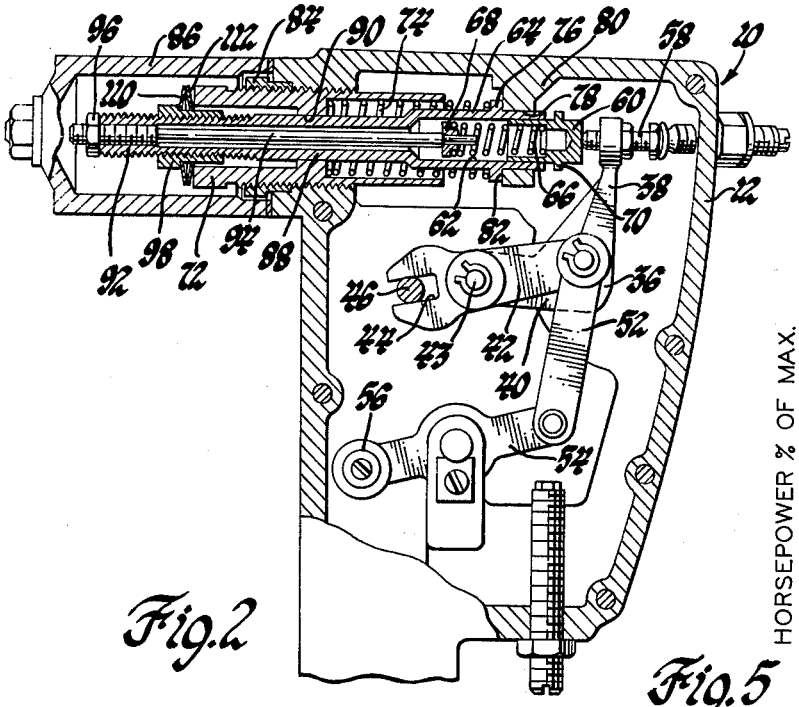
FIG. 2 is a cross-sectional view of the governor of FIG. 1 taken generally in the plane indicated by the line 2—2 of FIG. 1.

The governor embodiment shown in FIGS. 1–3 of the drawings differs from prior arrangements, as shown in the previously mentioned patents, in that plunger 64 has a tubular portion 88 that extends through and is reciprocable in a guiding bore 90 of retainer 72, the end 92 of tubular portion 88 being threaded externally and internally. The internal threads engage the threaded end of an adjusting rod 94 that supports the spring seat 68 for the low speed spring and provides the previously mentioned preload adjustment. A lock nut 96 is provided to retain the rod 94 in its adjusted position. The external threads of the plunger end 92 receive an internally threaded adjusting sleeve 98 having a cylindrical mounting portion 100 and a head 102 forming a radial abutment 104 adjacent portion 100. A recess 106 formed in the retainer 72 provides clearance to allow the cylindrical portion 100 to extend within the retainer. The retainer terminates in a flat annular end surface 108 spaced oppositely from abutment 104.

The adjusting sleeve 98 carries on its cylindrical portion 100 a pair of oppositely facing dished spring washers or Belleville washers 110, 112, which are arranged on portion 100 so that their outer edges engage one another, while their inner edges respectively bear against the radial abutment 104 of sleeve 98 and the end surface 108 of retainer 72. Washers 110, 112 together form a peak load control spring which, when compressed, biases plunger 64 leftwardly in a direction opposite that of the bias of spring 74. However, since the spring washers 110, 112 have a relatively small travel, this bias only occurs during a small portion of the plunger travel when the flange 76 is at or near the annular abutment 82.

The amount of bias applied by the spring 110, 112 and the distance through which it is effective is adjustable, to some extent, by rotating the adjusting sleeve 98 on the threaded end 92 of the plunger. However, in all cases the biasing effect of the spring 110, 112 is less than that of the high speed spring 74 so that the latter spring may cause the plunger flange to engage the abutment 82.

In operation of an associated engine, not shown, shaft 16 of the governor will be rotated at speeds proportional to engine speeds, causing the flyweights 20 to move outwardly and apply forces which are proportional to the squares of the engine speeds and tend to rotate the operating shaft lever 36 in a counterclockwise direction as viewed in FIG. 2. Such movement of the speed responsive means (which includes lever 36) moves the pivot pin 43 downwardly, causing the differential lever 42 to swing, as shown in FIG. 2, in a clockwise direction around the pin 46. This movement in turn moves the internal actuating means comprising link 52 and lever 54 in a direction tending to move the external fuel rack actuating mechanism (not shown) of the engine toward the minimum fuel position.

The force generated by the flyweights is opposed initially by the bias of low speed spring 66, together with the high speed spring 74. At low engine speeds, high speed spring 74 overcomes the peak load control spring formed by washers 110, 112, causing them to be squeezed to a flat, or near flat, condition between abutment 104 and end surface 108, thereby holding plunger 64 in its farthest rightward position as viewed in FIG. 2. At idle speed, low speed spring 66 extends cap 60 against adjusting screw 58 in the lever 36 and controls the engine idle speed by yielding or extending as necessary to permit the flyweight force to control fuel flow at required amount for maintaining idle speed.

Actuation of the accelerator by the operator to increase fuel moves the lever 50 so that the pin 46 is moved generally downwardly as shown in FIG. 2, pivoting lever 42 and the internal actuating means toward a position of increased injector rack. This increases fuel flow to the engine and gives a resultant increase in engine speed. increased speed results in an increased force being exerted by the flyweights which completely compresses spring 66, causing the flange stop 70 of the cap to engage the end of the plunger 64, thus providing a nonyieldable connection between the lever 36 and the plunger.

Between idle and the maximum controlled engine speed, the rack position is set manually by the engine operator. However, when the maximum controlled speed range is reached, the force of the flyweights 20 becomes high enough to begin compressing the high speed spring 74, which yields as necessary to reduce the injector output by moving the engine injector racks toward the minimum fuel position so that the maximum controlled speed is not exceeded. The range of maximum controlled speeds is shown in FIG. 5 to extend from the maximum controlled speed at no load down to about 90 percent of the maximum controlled speed at no load when the engine is operated under full load.

Figure 5:
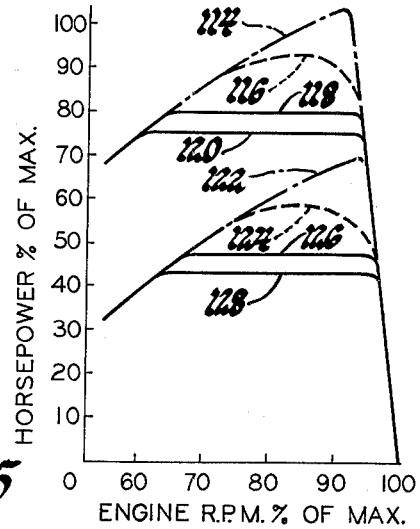
FIG. 5 is a graph of characteristic horsepower speed curves showing the improved effect of the present peak load control spring in flattening the engine power curves at various fuel rack and load control spring preload settings.

FIG. 5 compares the effect on engine horsepower and speed of three similar governors. The unevenly dashed line 114 represents the maximum load-speed curve of a conventional governor without a peak load control spring. The evenly dashed line 116 represents a modified governor having a peak load control spring of the sort shown in U.S. Pat. No. 3,886,922. The solid lines 118, 120 represent the maximum load-speed curves which may be obtained with a governor according to the present invention at two different preload adjustments of the peak load spring 110, 112.

As may be seen, the maximum load-speed curve 114 of the governor without a peak load control spring shows a generally rising horsepower curve which peaks near 90 percent of the maximum speed. From this point to the maximum no load engine speed, the horsepower is governed by the engine governor so that increasing the speed beyond 90 percent causes a rapid reduction in horsepower until the no load condition is reached at full speed.

The governor of U.S. Pat. No. 3,886,922 provides the modified load curve of line 116 which is relatively flatter than the uncontrolled governor in the range from about 70 to 95 percent of the maximum speed. With this governor, the change in horsepower with speed is substantially reduced, but a definite variation remains over the controlled speed range. The effect of the peak load control spring in this case is to reduce the effective rate of the spring combination acting on the plunger 64 in the initial portion of the compression of the high speed spring as the plunger moves away from the abutment 82 to control maximum speed. This effect causes movement of the plunger to begin at a lower speed than otherwise and to continue at a slower than normal rate in proportion to increasing speed until the end of the travel of the peak load control spring is reached. Further compression of the high speed spring thereafter follows the same diagonal load line as would be the case if the peak load control spring were not present in the combination.

The improved arrangement of the present invention provides two further advantages. First, as may be seen by the solid line 118, the maximum horsepower at which the engine is controlled may be held constant or nearly constant over a predetermined range which, in the example of the figure, is from about 65 to 95 percent of the maximum engine speed. In addition, adjustment of the preload on the peak load control spring 110, 112 permits some variation in the controlled maximum horsepower, line 120 indicating for example a horsepower setting somewhat lower than that of line 118.

In FIG. 5, the upper set of lines 114–120 represent engine output when the operator has the manual rack control or accelerator pedal at its full output position. The lower set of lines 122–128 represent the correspondingly lower output figures that would result from operation of the various governor arrangements with the manual throttle set at a reduced power output setting.

The additional advantages of the peak load control governor of the present invention over the earlier peak load control governor of U.S. Pat. No. 3,886,922 result from several modifications. First the spring rate of the peak load control spring formed by dished washers 110, 112 is matched to the exponential increase of force with speed of the centrifugal flyweights to provide, in combination with the high speed spring 74, a decreasing spring rate for travel of the actuating means represented by plunger 64 toward its maximum fuel position in the controlled portion of its travel. When the decreasing spring rate of the peak load control spring is properly selected and matched, the result is the substantially flat curve of peak engine horsepower over the extended speed range shown by lines 118 and 120 of FIG. 5. This result gives an ideal operating characteristic for diesel engine powered trucks which reduces the need for shifting gears under varying load conditions while providing improved performance characteristics over trucks with unmodified engine governors. Additional features, the relocation of the peak load control spring to a position under the removable cover 86 and provision of the adjusting sleeve 98, provide the added advantage of selectability within a limited range of the desired maximum horsepower at which the engine is to be operated.

It should be noted that the Belleville or dished washer type peak load control spring is particularly well adapted to be designed to have the characteristic of reduced spring rate upon increased compression which, in the governor and engine combination described, produces the flat horsepower curves indicated in FIG. 5. Thus, although other types of springs may be made suitable, the Belleville washer spring is particularly well adapted to this application.

Figure 6:
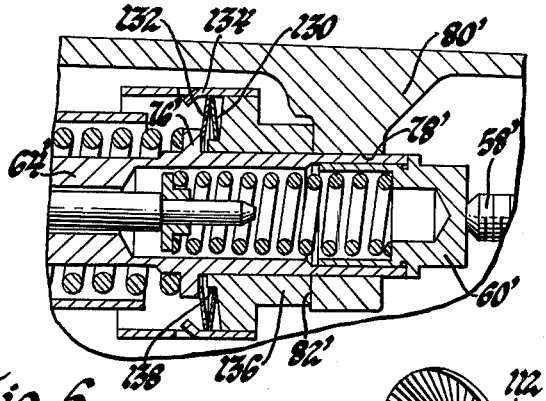
FIG. 6 is a fragmentary cross-sectional view similar to a portion of FIG. 2 but showing an alternative embodiment of the invention.
Figure 4:
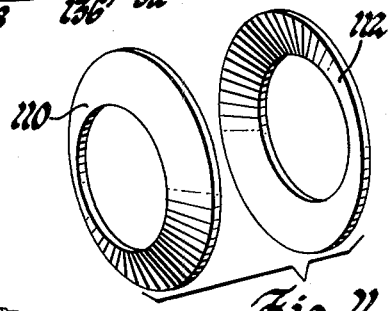
FIG. 4 is a pictorial view of a peak load control spring in the form of a pair of Belleville washers as used in the illustrated embodiments of the invention.

In FIG. 6 an alternative embodiment of governor arrangement is illustrated in which the dished washer type peak load control spring is also utilized, but is located in a position similar to that of the prior arrangement of U.S. Pat. No. 3,886,922. In the FIG. 6 embodiment, two oppositely disposed washer springs 130, 132 are maintained by a retainer 134 against a stepped spacer 136 on which the retainer 134 is mounted. One end of the spacer 136 engages the governor housing abutment 82', while the other end is adapted to be engaged by the flange 76' of plunger 64' so as to limit the maximum compression of the springs 130, 132 to a predetermined value. The desired maximum controlled load of the engine is set in advance by properly sizing the length of the spacer step 138. In the modified arrangement, the washer springs 130, 132, spacer 136 and retainer 134 provide a prefabricated cartridge in which the load settings are controlled in manufacture and the problems of operator tampering are reduced. While the modified governor arrangement of FIG. 6 does not provide the adjustment feature of the first described embodiment, it does provide for the use of Belleville washer springs having the necessary decreasing spring rate upon compression to provide the desirable flat horsepower curve over an extended engine speed range as provided in the first described embodiment.

While the invention has been described by reference to certain preferred embodiments chosen to illustrate the concepts of the invention, it is apparent that the inventive concepts are not limited to the specific embodiments disclosed. It is accordingly intended that the invention not be limited except by the language of the following claims.

What is claimed is:

1. A governor for limiting the maximum speed of an internal combustion engine operable at varying speeds and loads and having a fuel control actuator for varying fuel input, said governor comprising a housing carrying actuating means connectable with such fuel control actuator, said means being movable between maximum and minimum fuel positions, centrifugal speed responsive means in said housing and connected with said actuating means, at least during operation above a predetermined speed, said speed responsive means being arranged to urge said actuating means toward its minimum fuel position with a force varying as an exponential function of the engine speed and increasing with increased engine speed, a first spring in said housing and biasing said actuating means toward its maximum fuel position over the full range of travel of said first spring, and a second spring acting on said actuating means in opposition to said first spring during a portion of the travel of said actuating means adjacent its maximum fuel position, said second spring being weaker than said first spring and acting therewith to provide a reduced spring rate for travel of said actuating means over said portion of such travel near its maximum fuel position, said second spring being designed to provide, in combination with said first spring, a decreasing spring rate for travel of said actuating means toward its maximum fuel position in said portion of such travel near its maximum fuel position, said decreasing spring rate being matched to partially offset the increase of force with increased speed of said centrifugal speed responsive means such that movement of said actuating means during said portion of travel near its maximum fuel position equals a substantially constant function of the change in engine speed during said portion of travel.

2. A governor as defined in claim 1 and further comprising a retainer adjustably carried by one of said actuating means and housing members and disposed externally of said housing, said second spring being engageable with said retainer such that adjustment of said retainer on said one member varies the loading of said second spring and thereby varies the effective spring rate for travel of said actuating means near its maximum fuel position, said housing having a cover removably mounted thereon and enclosing said retainer, said cover being removable to permit adjustment of said retainer during operation of said governor to provide for establishing the desired preload on said second spring under predetermined operating conditions.

3. A governor as defined in claim 1 wherein said second spring comprises at least one Belleville washer capable of being compressed to a near-flat condition and having a variable spring rate that declines upon increasing compression of said washer.

4. In combination, a compression ignition internal combustion engine operable at varying speeds and loads and having fuel injection means operable to deliver fuel to the cylinders at a predetermined, relatively constant rate per cycle over the range of engine speeds, a fuel rack actuator connected with the injection means and movable to vary the predetermined rate of fuel injection per cycle as a direct function of such movement, and the improvement comprising a governor having a housing carrying actuating means connectable with such fuel rack actuator, said means being movable between maximum and minimum fuel positions, centrifugal speed responsive means in said housing and connected with said actuating means, at least during operation above a predetermined speed, said speed responsive means being arranged to urge said actuating means toward its minimum fuel position with a force varying as the square of the engine speed and increasing with increased engine speed, a first spring in said housing and biasing said actuating means toward its maximum fuel position over the full range of travel of said first spring, and a second spring acting on said actuating means in opposition to said first spring during a portion of the travel of said actuating means adjacent its maximum fuel position, said second spring being weaker than said first spring and acting therewith to provide a reduced spring rate for travel of said actuating means over said portion of such travel near its maximum fuel position, said second spring being designed to provide, in combination with said first spring, a decreasing spring rate for travel of said actuating means toward its maximum fuel position in said portion of such travel near its maximum fuel position, said decreasing spring rate being matched to partially offset the increase of force with increased speed of said centrifugal speed responsive means such that movement of said actuating means during said portion of travel near its maximum fuel position equals a substantially constant function of the change in engine speed during said portion of travel, whereby movement of said governor actuating means in response to changes in engine speed is effective to maintain the absolute fuel rate to said engine approximately constant over the range of movement of said actuating means corresponding to the travel of said second spring.

5. The combination of claim 4 and further comprising a retainer adjustably carried by one of said actuating means and housing members and disposed externally of said housing, said second spring being engageable with said retainer such that adjustment of said retainer on said one member varies the loading of said second spring and thereby varies the controlled fuel rate established during such movement of said actuating means near its maximum fuel position, said housing having a cover removably mounted thereon and enclosing said retainer, said cover being removable to permit adjustment of said retainer during operation of said engine to provide for establishing the desired maximum fuel rate setting under predetermined operating conditions.

6. The combination of claim 4 wherein said second spring comprises at least one non-planar washer capable of being compressed to a near-flat condition and having a variable spring rate that declines upon increasing compression of the washer toward said flat condition.

7. The combination of claim 6 wherein said second spring is a dished Belleville washer.

8. A governor for limiting the maximum speed of an internal combustion engine operable at varying speeds and loads and having a fuel control actuator for varying fuel input, said governor comprising, a housing carrying actuating means connectable with such fuel control actuator, said means being movable between maximum and minimum fuel positions, speed responsive means in said housing and connected with said actuating means, at least during operation above a predetermined speed, said speed responsive means being arranged to urge said actuating means toward its minimum fuel position with a force increasing as a function of increased engine speed, a first spring in said housing and biasing said actuating means toward its maximum fuel position over the full range of travel of said first spring, a second spring acting on said actuating means in opposition to said first spring during a portion of the travel of said actuating means adjacent its maximum fuel position, said second spring being weaker than said first spring and acting therewith to provide a reduced spring rate for travel of said actuating means over said portion of such travel near its maximum fuel position, and a retainer adjustably carried by one of said actuating means and housing members and disposed externally of said housing, said second spring being engagable with said retainer such that adjustment of said retainer on said one member varies the loading of said second spring and thereby varies the effective spring rate for travel of said actuating means near its maximum fuel position, said housing having a cover removably mounted thereon and enclosing said retainer, said cover being removable to permit adjustment of said retainer during operation of said governor to provide for establishing the desired preload on said second spring under predetermined operating conditions.

* * * * *